US008672535B2

(12) United States Patent
Boulenguiez et al.

(10) Patent No.: US 8,672,535 B2
(45) Date of Patent: Mar. 18, 2014

(54) SPIRAL-SPRING BALANCE WHEEL REGULATING MEMBER

(75) Inventors: Benoit Boulenguiez, Annemasse (FR); Eric Jolidon, Les Acacias (CH)

(73) Assignee: Rolex S.A., Geneva (CH)

( * ) Notice: Subject to any disclaimer, the term of this patent is extended or adjusted under 35 U.S.C. 154(b) by 94 days.

(21) Appl. No.: 13/248,423

(22) Filed: Sep. 29, 2011

(65) Prior Publication Data

US 2012/0082010 A1 Apr. 5, 2012

(30) Foreign Application Priority Data

Oct. 4, 2010 (EP) ..... 10405183

(51) Int. Cl.
*G04B 1/22* (2006.01)

(52) U.S. Cl.
USPC ..... 368/169; 368/175

(58) Field of Classification Search
USPC ..... 368/169–178
See application file for complete search history.

(56) References Cited

U.S. PATENT DOCUMENTS

| | | | | |
|---|---|---|---|---|
| 3,154,912 | A * | 11/1964 | Pinkas | 368/176 |
| 2005/0073912 | A1* | 4/2005 | Geyer | 368/127 |
| 2005/0073913 | A1* | 4/2005 | Born et al. | 368/127 |
| 2008/0117721 | A1 | 5/2008 | Glashutte et al. | |
| 2009/0116343 | A1 | 5/2009 | Levingston | |
| 2010/0027382 | A1 | 2/2010 | Daout et al. | |

FOREIGN PATENT DOCUMENTS

| | | | |
|---|---|---|---|
| EP | 1515200 | A1 | 3/2005 |
| EP | 1918791 | A1 | 5/2008 |
| EP | 2151722 | A1 | 2/2010 |
| WO | 2006/123095 | A2 | 11/2006 |
| WO | 2010/088891 | A2 | 8/2010 |

OTHER PUBLICATIONS

European Search Report (ESR) of European Appl. No. 10405183, dated Mar. 15, 2011.

* cited by examiner

*Primary Examiner* — Amy Cohen Johnson
*Assistant Examiner* — Matthew Powell
(74) *Attorney, Agent, or Firm* — Westerman, Hattori, Daniels & Adrian, LLP

(57) ABSTRACT

This spiral-spring and balance wheel regulating member includes a shaft mounted pivotably on the frame of a timepiece. The spiral spring includes at least one blade, whose inner end is designed to be fixed to the pivot shaft and whose outer end is made in one piece with a member (2) for connection to the frame, the rigidity of this connecting member being substantially greater than that of the spiral. The connecting member (2), on one hand, and the frame (9) or a member (6) for the angular positioning of the regulating member on the frame, on the other hand, both have respective bearing surfaces which are at least partially complementary, and these complementary bearing surfaces are joined.

27 Claims, 11 Drawing Sheets

SPIRAL-SPRING BALANCE WHEEL REGULATING MEMBER

The present invention relates to a spiral-spring and balance wheel regulating member including a shaft mounted pivotably on the frame of a timepiece, in which the spiral spring of the regulating member includes at least one blade located in a plane, whose inner end is designed to be fixed to the pivot shaft and whose outer end is made in one piece with a member for connection to the frame, the rigidity of this connecting member being substantially greater than that of the spiral. The invention also relates to a timepiece movement or to a timepiece comprising a regulating member of this kind.

There is a plurality of known methods of fastening the outer end of the spiral spring to the frame of the timepiece. As a general rule, this end is fixed, unlike the inner end which is fastened to a collet pressed onto the balance wheel shaft and which oscillates with the spiral-spring and balance wheel regulating member. In most cases, the outer end of the spiral is connected to a fixing stud or flange which is then fastened to a balance bridge.

One method of fastening the end of the spiral spring to a stud is to place it in a hole provided for this purpose in the stud, and then to secure it with a pin or by bonding. The stud is then inserted into a corresponding housing and fixed in position by pressing or by means of a screw.

The position of the spiral spring with respect to the balance wheel shaft must be adjusted in a precise way, because any eccentricity of the spiral spring or any departure from perpendicularity with respect to this shaft gives rise to serious timekeeping faults, particularly in relation to the isochronism of the regulating member. The stud must therefore be perpendicular to the plane of the spiral spring and must be positioned in a precise way to ensure the concentric development of the spiral spring. In the case of a conventional spiral spring made from an alloy, when the outer end of the spiral spring has been fixed to the balance bridge, directly or by means of an angular adjustment member, any defects created in the ideal three-dimensional shape of the spiral spring are corrected by plastic deformation of the outer end of the spiral spring. This is a highly complex operation which can only be performed by an experienced watchmaker. Moreover, this method of correction is evidently unsuitable for spiral springs made from fragile materials such as silicon, as this kind of material cannot be deformed in a plastic way.

Spiral-spring and balance wheel regulating members in which the outer end of the spiral spring is made in one piece with a frame connection member and which have a substantially greater rigidity than the spiral spring have been described in EP 1 515 200 for example, and also in WO 2006/123095 and EP 2 151 722. However, the proposed methods of fixing the outer end are still related to the conventional stud fixing method, in that they provide only a single attachment point which cannot ensure that the spiral spring, in its rest position, will retain the three-dimensional integrity of its initial shape after it has been fixed.

Thus these solutions cannot overcome the problem of fixing the outer end of a spiral spring in such a way that no correction is needed after fixing. This is because, when these conventional fixing methods are used, it is impossible to ensure that there will be no deformation in the spiral spring, that the spiral spring will maintain a concentric development with respect to the balance wheel pivot axis during the oscillation of the spiral-spring and balance wheel regulating member, or that the spiral spring will remain perpendicular to this axis.

If the spiral spring is made from a fragile material such as silicon, diamond or quartz, adjustment of the spiral spring by plastic deformation becomes impossible, and therefore the use of a stud requires extremely narrow manufacturing tolerances and a robust stud and spring assembly to ensure that the axis of the stud and the plane of the spiral spring are completely perpendicular to each other, or as nearly perpendicular as possible. This clearly gives rise to major difficulties in industrial production. Indeed, the clamping of the stud in its housing, by means of a screw for example, is in itself capable of changing the orientation of the stud and thus modifying the initial three-dimensional shape of the spiral spring.

It has been proposed, in EP 1 918 791 for example, that the stud be provided with means for modifying its angular or radial position, in order to correct defects in the concentric development of the spiral spring without the need for plastic deformation of the spiral spring. However, this solution cannot correct defects in the perpendicularity of the spiral spring with respect to the axis of the balance wheel. This solution also requires a high degree of skill for the very precise adjustment of an element which is located at the end of a spiral spring and which is therefore subject to the action of a large lever arm.

The object of the present invention is to overcome, at least partially, the aforementioned drawbacks.

For this purpose, the invention proposes a spiral-spring and balance wheel regulating member as claimed in claim 1.

Various embodiments of the regulator are defined by claims 2 to 17.

A timepiece movement according the invention is defined by claim 18.

A timepiece according the invention is defined by claim 19.

Advantageously, the profile and angular extension of the complementary bearing surfaces of the connecting member and of the frame or of a member for the angular positioning of the regulating member on the frame have a shape and size such that the three-dimensional integrity of the initial shape of the spiral spring is preserved in the resting state, after the complementary bearing surfaces have been fixed to each other.

The angular extension of the bearing surfaces may be large. It may be as great as 360°, which will provide an extremely stable support. Such complementary bearing surfaces can be produced with a very high degree of precision. For a given manufacturing tolerance, a large bearing surface or a plurality of separate bearing surfaces located along the connecting member with a large angular interval will impart a greater geometrical stability to the assembly. The bearing surface fastened to the outer end of the spiral spring is advantageously made in one piece with the spiral spring, particularly if the spiral spring is cut from a silicon plate, thus enabling a very high degree of precision to be achieved.

Advantageously, the respective bearing surfaces, which are at least partially complementary, of the connecting member and of the frame or of the member for the angular positioning of the regulating member on the frame include at least two elements for positioning the outer end of the spiral spring with respect to the axis of the balance wheel shaft and to the fixing of the inner end of the spiral spring on the balance wheel shaft, in order to position these ends as precisely as is permitted by the tolerances. Ideally, these positioning elements enable the initial shape of the spiral spring to be preserved in the resting position of the regulating member.

The attached drawings show, schematically and by way of example, various embodiments of the regulating member proposed by the invention.

Figure 1:
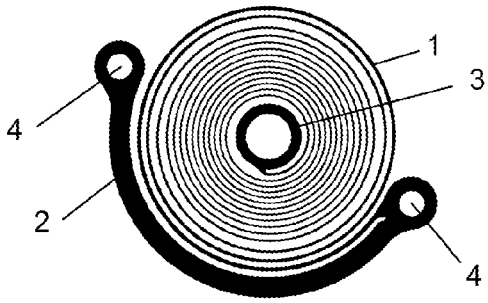
FIGS. 1 to 8 are plan views of some but not all of the various possible shapes of the connecting member and the bearing surface or surfaces fastened to the outer end of the spiral spring forming part of this regulating member.
Figure 2:
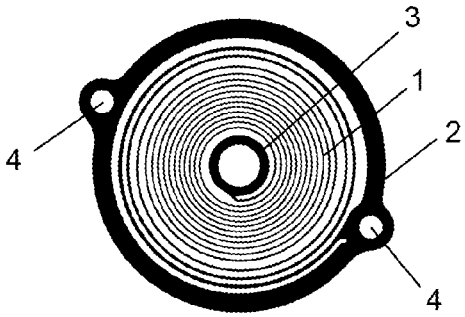
Figure 3:
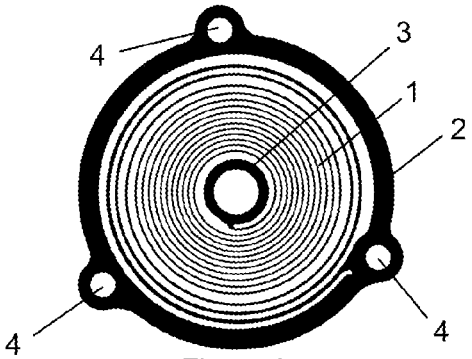
Figure 4:
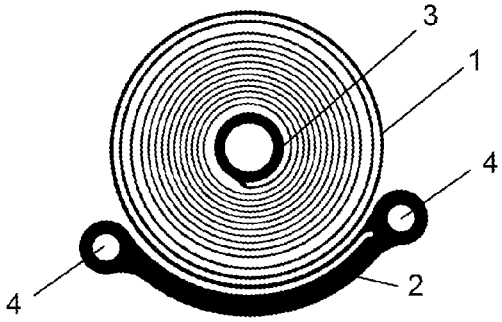
Figure 5:
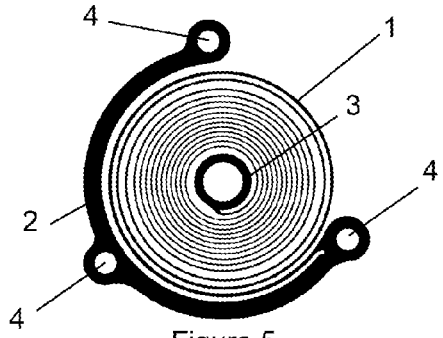

FIGS. 1 to 8 show eight variants of spiral springs 1 whose outer ends are made in one piece with a member 2 for connection to the frame of a timepiece. The rigidity of this connecting member 2 is substantially greater than that of the spiral 1, being typically 1000 times greater in the plane of the spiral, and 10 times greater perpendicularly to the plane of the spiral. Preferably, the inner end of each of these spiral springs is also made in one piece with a fixing collet 3, designed to be pressed in the usual way onto the pivot shaft of a balance wheel. As can be seen, the connecting member 2 extends angularly with respect to the pivot axis of the shaft onto which the collet 3 is to be pressed. This connecting member can therefore provide at least one stable bearing surface for the spiral spring 1, if it is associated with a bearing surface which is at least partially complementary, as described below. These bearing surfaces are substantially parallel to the plane of the spiral spring 1.

In the variants of FIGS. 1 to 7, the connecting member 2 advantageously includes two or possibly three positioning and fixing elements, formed by openings 4 for the passage of fixing members such as pins or screws. These openings are preferably distributed angularly to enable the connecting member 2 to be applied against the complementary bearing surface at a plurality of points on its bearing surface. Thus, subject to the accepted tolerances, the spiral spring retains the three-dimensional integrity of its initial shape when in the resting state, once the connecting member has been fixed to its complementary bearing surface.

Figure 6:
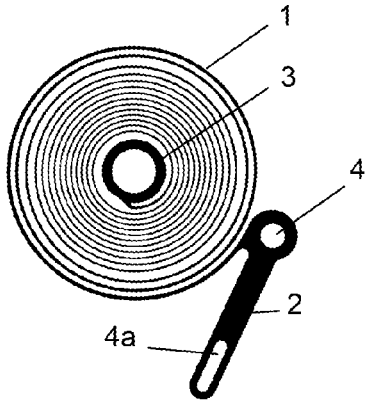
Figure 7:
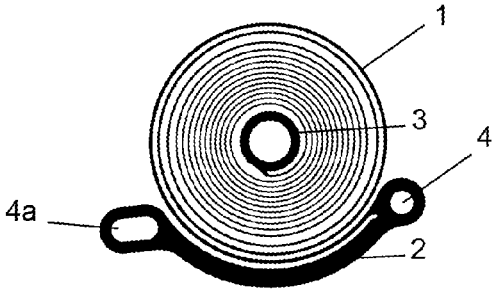

As shown in FIGS. 6 and 7, some of the openings 4*a* can be non-circular, being of elongate shape for example, for the correction of any small centering defects due to the accepted tolerances. Thus, the opening of elongate shape 4*a* can be associated with an eccentric adjustment member whose angular displacement permits fine adjustment of the centering of the spiral with respect to the frame, by the rotation of the connecting member 2 with respect to the center of the opening 4, the connecting member 2 being clamped after the centering of the spiral spring 1. The fineness of the positioning is proportional to the separation between the openings 4 and 4*a*. The eccentric adjustment member can also be associated with the circular opening 4, but this variant is less favorable for the adjustment, since it requires both openings 4 and 4*a* to be moved by the action of the adjustment member.

Figure 8:
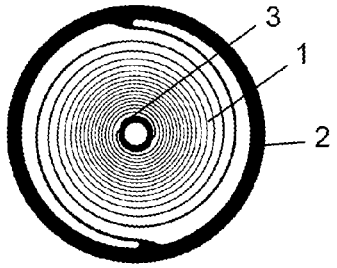
Figure 20:
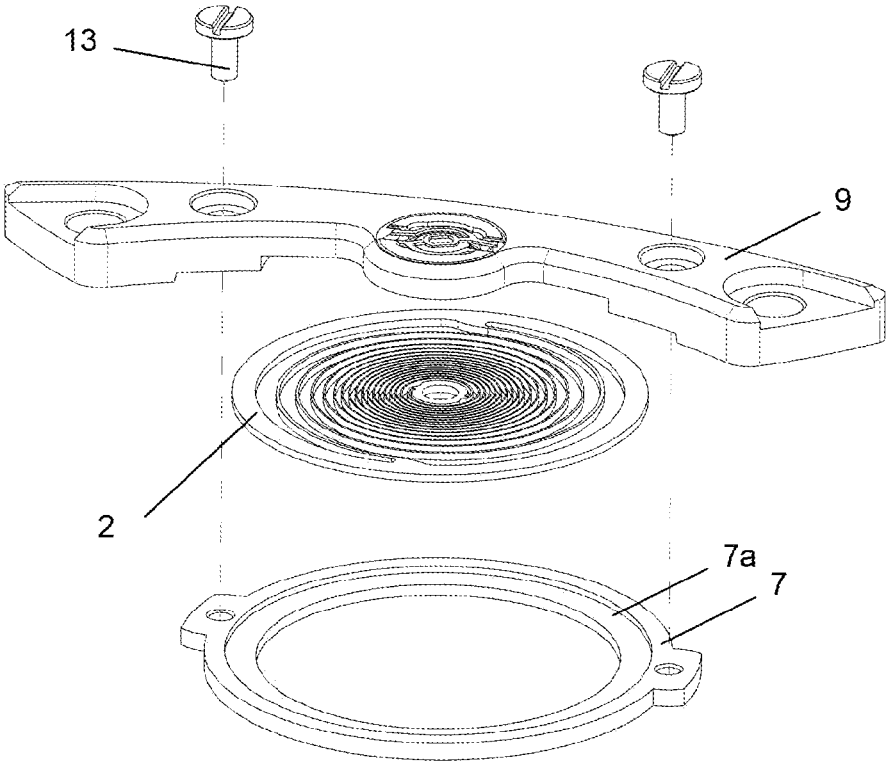
FIG. 20 is an exploded perspective view of a variant of a second embodiment.
Figure 21:
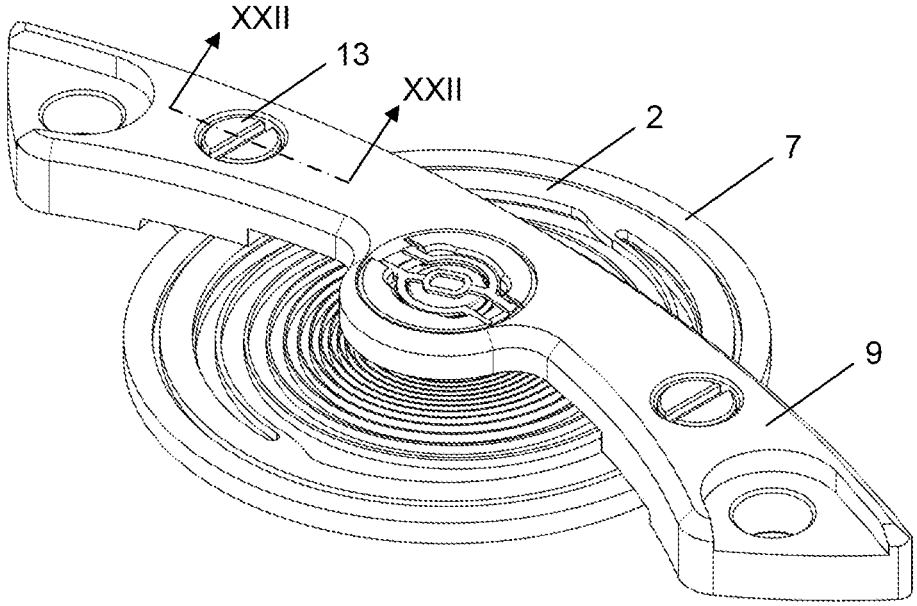
FIG. 21 is an assembled perspective view of FIG. 20.
Figure 22:
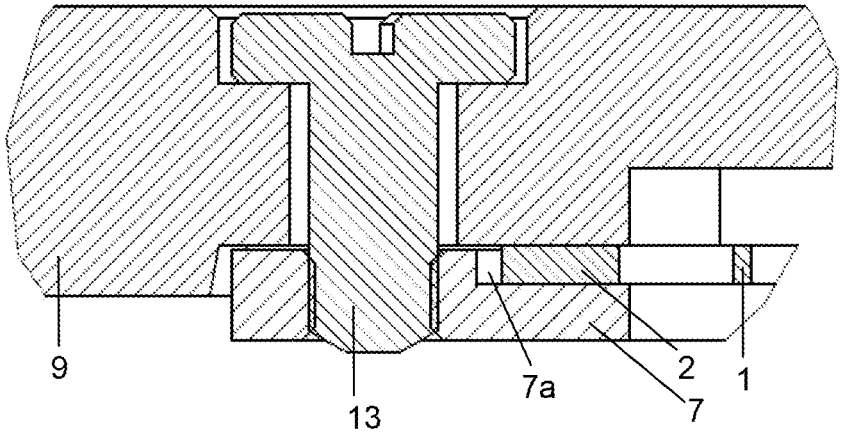
FIG. 22 is a section taken along the line XXII-XXII of FIG. 21.

The variant in FIG. 8 relates to an annular connecting member 2, in this case associated with a spiral spring having two blades offset angularly by 180°, wherein the connecting member 2 does not include a positioning and fixing element. This annular connecting member 2 can be fixed, for example, as shown in FIGS. 20 to 22 which are described below.

Clearly, the annular connecting member 2 of FIG. 8 can also be used with a spiral spring having a single blade, such as those shown in FIGS. 1 to 7. On the other hand, the annular connecting members 2 of FIGS. 1-7 can also be used with spiral springs of the type having a plurality of blades.

There are various possible solutions for fixing the connecting member 2 to the frame of the timepiece movement. The connecting member can be fixed directly to the balance bridge, or, advantageously, it can be fixed to the balance bridge by means of an intermediate part, mounted pivotably about the pivot axis of the balance wheel shaft, thus making it possible to set the reference position of the timepiece. The reference position is set by bringing the center of the impulse pin of the balance wheel on to the line linking the corresponding pivot centers of the balance wheel and the lever when the spiral-spring and balance wheel regulating member is in the equilibrium position.

Figure 9:
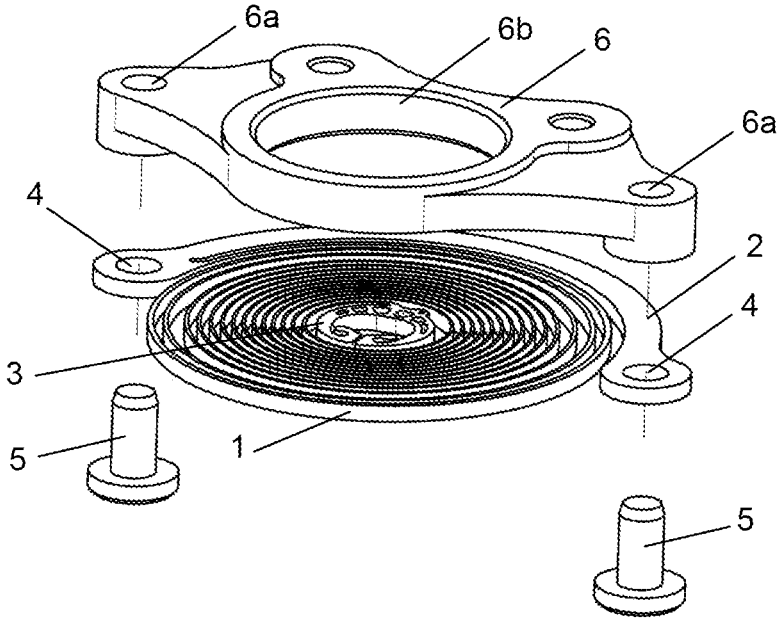
FIG. 9 is an exploded perspective view of a first step of the assembly of a first variant of a first embodiment.

FIGS. 9 to 12 show a first variant of a first embodiment, in which the connecting member 2 includes at least two positioning elements and corresponding bearing surfaces. FIG. 9 shows a spiral spring similar to that illustrated in FIG. 1. Two fixing pins 5 are designed to pass through the openings 4 in the connecting member 2 and to be pressed into corresponding openings 6*a* formed in an intermediate part 6, provided with an opening 6*b* which is concentric with the central axis of the collet 3 after the assembly of the elements of FIG. 9. The opening 6*b* in this intermediate part 6 is designed to be adjusted over a circular range of the balance bridge coaxial with the pivot axis of the balance wheel shaft, to enable the reference position to be set as described below. This intermediate part 6 therefore acts as an angular positioning member of the spiral-spring and balance wheel regulating member.

Figure 10:
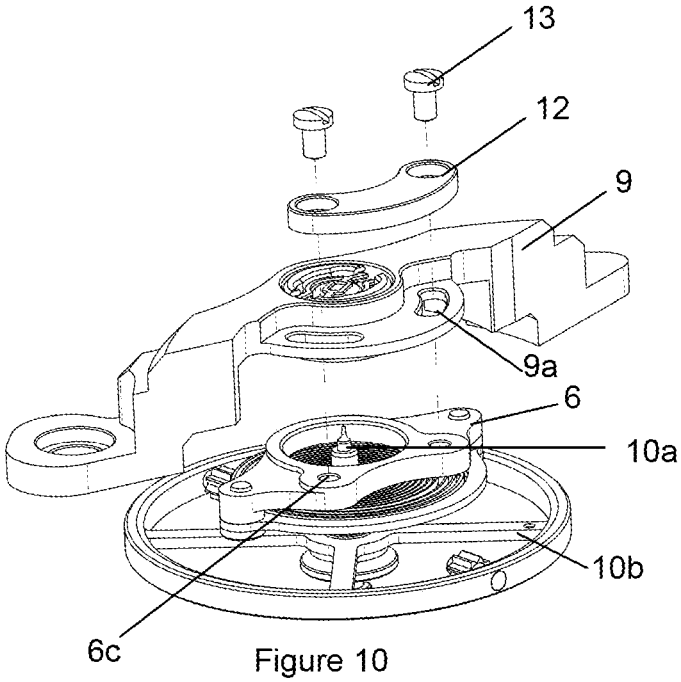
FIG. 10 is an exploded perspective view of a second step of the assembly of the first variant of the first embodiment shown in FIG. 9.

FIG. 10 shows the step of assembly following that of FIG. 9. The angular positioning member 6 is mounted pivotably about the balance bridge 9, and is fixed to the latter by means of two screws 13, which pass through a clamping plate 12 on the one hand and through two oblong cut-outs 9*a* in the balance bridge 9 on the other hand, and are screwed into two tapped holes 6*c* in the angular positioning member 6. In this case, the clamping plate 12 is curved and is mounted on the plate of the balance bridge 9. The pivot shaft of the balance wheel 10*a* and the balance wheel 10*b* can be attached to the spiral before or after the mounting of the intermediate part 6.

Figure 11:
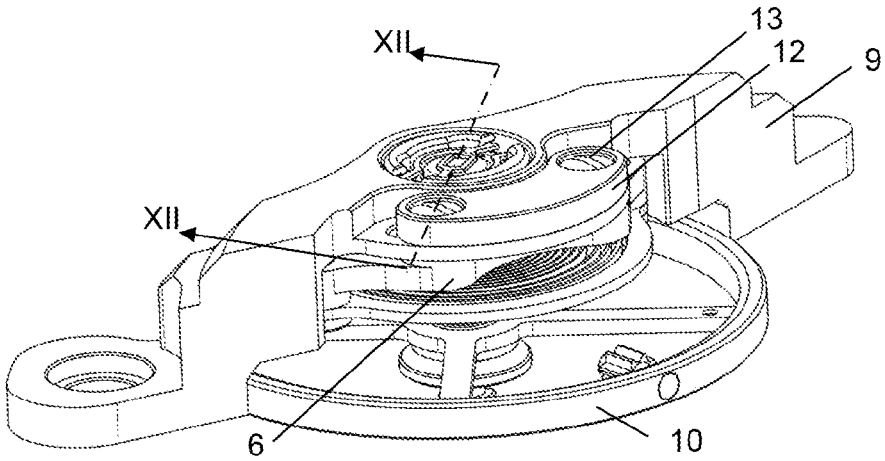
FIG. 11 is an assembled perspective view of FIG. 10.

FIG. 11 shows this first variant in the assembled condition. The reference point of the spiral-spring and balance wheel regulating member 10 can be set by slackening the two screws 13 slightly, then pivoting the fixed assembly formed by the spiral 1 whose inner end is fastened to the shaft 10*a* of the spiral-spring and balance wheel 10, the angular positioning member 6, and the clamping plate 12.

Figure 12:
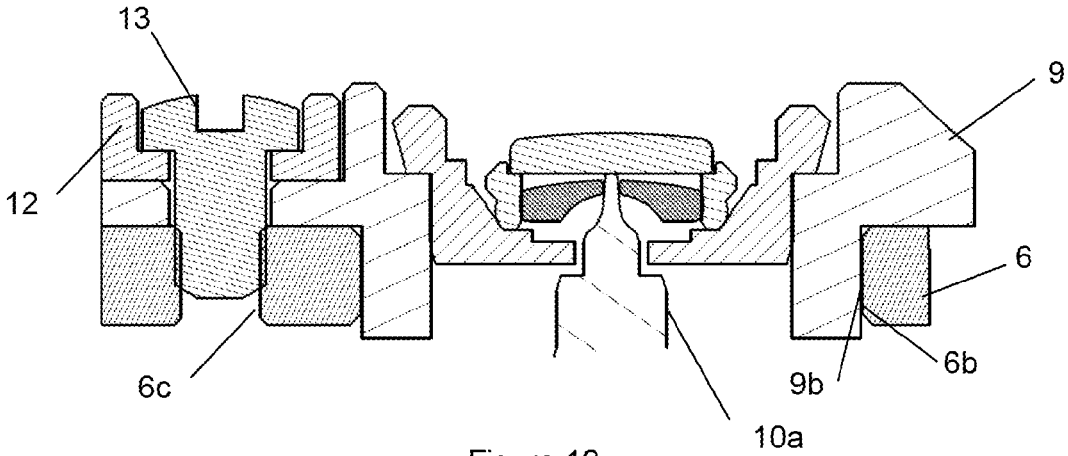
FIG. 12 is a section taken along the line XII-XII of FIG. 11.

FIG. 12 shows a section through FIG. 11, to demonstrate the way in which the angular positioning member 6 is mounted pivotably by means of its opening 6*b* about a cylindrical range 9*b* of the balance bridge 9.

Figure 13:
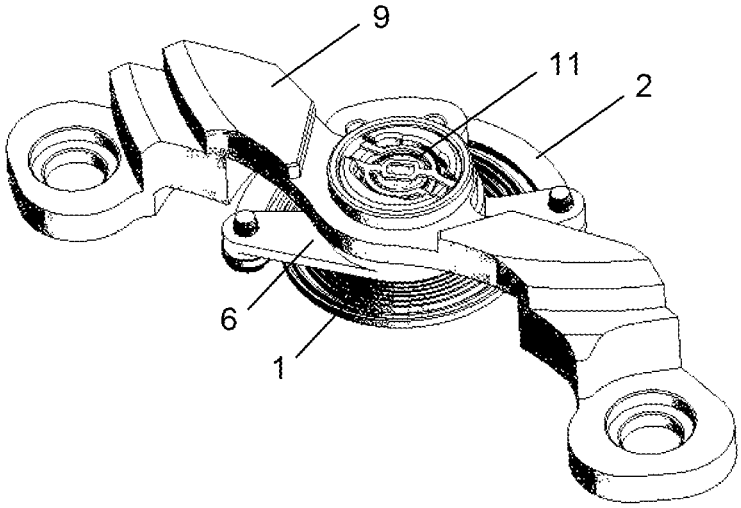
FIG. 13 is a perspective view of a first step of the assembly of a second variant of the first embodiment.
Figure 14:
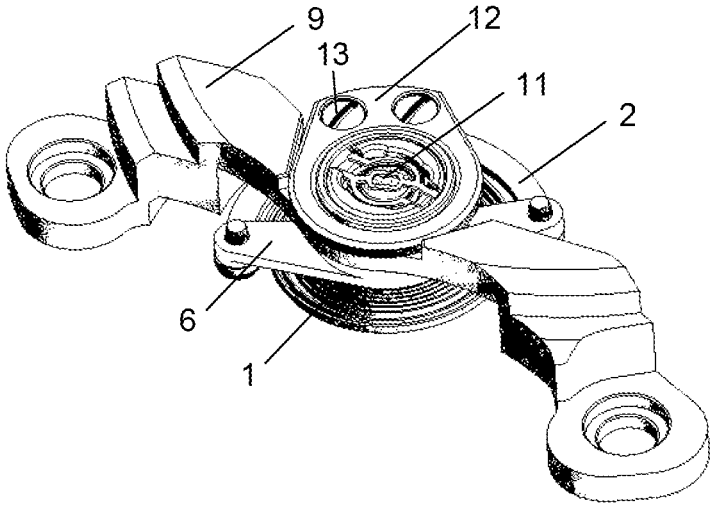
FIG. 14 is a perspective view of a second step of the assembly of the variant shown in FIG. 13.

FIGS. 13 and 14 show a second variant of the first embodiment. The spiral spring 1 which is used corresponds to that shown in FIG. 1. It includes a connecting member 2 extending through approximately 180° about the pivot axis of the balance wheel shaft, whose ends are fixed to the angular positioning member 6 mounted pivotably under the balance bridge 9 about the pivot bearing 11 of one of the ends of the balance wheel shaft. FIG. 13 shows this angular positioning member 6 and FIG. 14 shows the same elements as FIG. 13, but after a plate 12 has been fixed to this angular positioning member 6 by two screws 13. The plate 12 and the angular positioning member 6 are thus mounted by a friction fit about the bearing 11, enabling the reference position to be set in a conventional way as with a standard stud holder.

Figure 15:
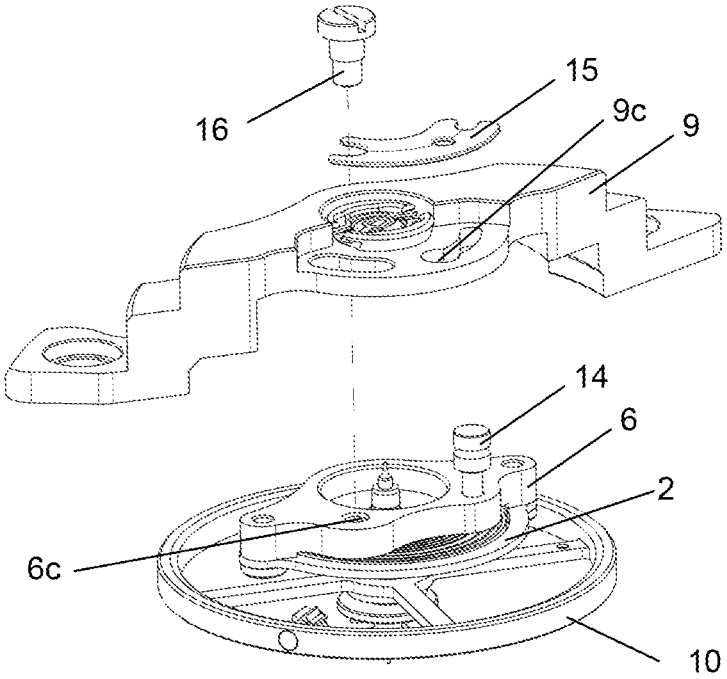
FIG. 15 is an exploded perspective view of a third variant of the first embodiment.
Figure 16:
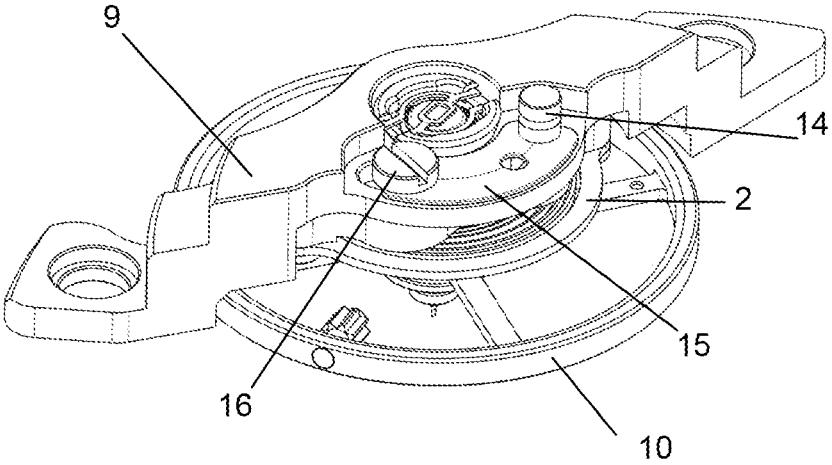
FIG. 16 is an assembled perspective view of FIG. 15.

FIGS. 15 and 16 show a third variant of the first embodiment wherein the angular positioning member 6 carries a shouldered pin 14 for the provisional fixing of the spiral-spring and balance wheel regulating member 10 in a bayonet fixing opening 9*c* formed in the plate of the balance bridge 9 as shown in FIG. 15. A foil 15 is then placed with one of its ends between the plate of the balance bridge 9 and the shoulder of the pin 14, while its other end is located between the plate of the bridge 9 and the head of a single shouldered screw 16 which is screwed so as to bear on the angular positioning member 6, thus generating sufficient frictional torque to hold the connecting member 2 while allowing the easy setting of the reference position of the spiral-spring and balance wheel regulating member 10.

Figure 17:
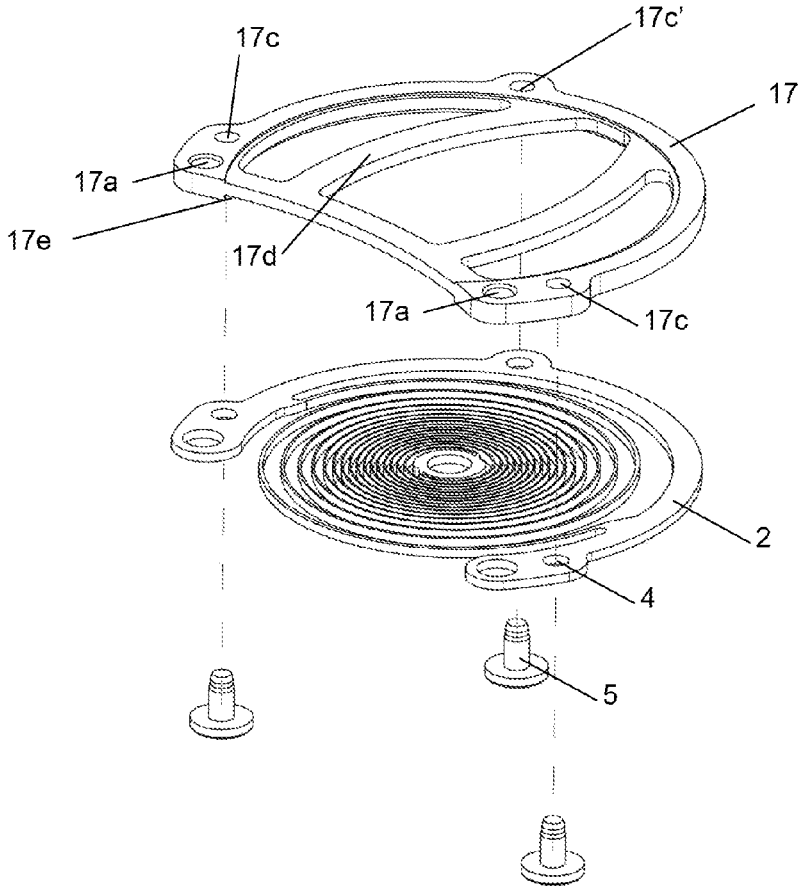
FIG. 17 is an exploded perspective view of a first step of the assembly of a fourth variant of the first embodiment.
Figure 18:
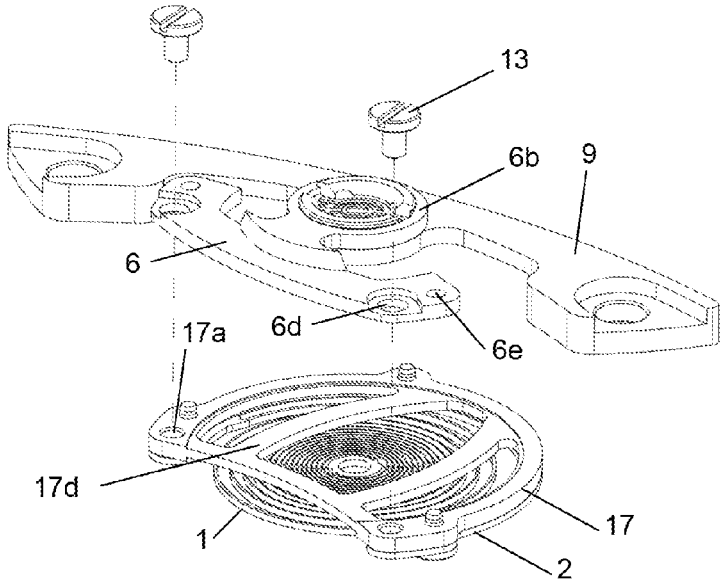
FIG. 18 is an exploded perspective view of a second step of the assembly of the variant shown in FIG. 17.
Figure 19:
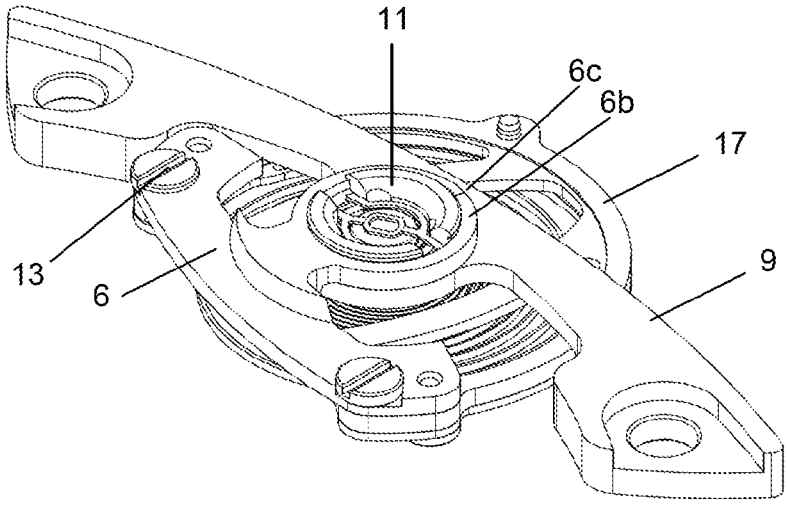
FIG. 19 is an assembled perspective view of FIG. 18.

FIGS. 17 to 19 show a fourth variant of the first embodiment, which is particularly suitable for the mounting of a double spiral in which the outer ends of the blades are fastened to a connecting member 2 in the shape of a ring, in this particular case an open ring.

FIG. 17 shows a first step of assembly. In this case, the spiral 1 is fastened to the spiral support 17 by three pins 5 which pass through the openings 4 of the spiral 1 and are pressed into the openings 17*c* of the intermediate part 17.

The fixing points can be simple circular positioning holes 4 formed in the ring-shaped connecting member 2. In a variant, the positioning holes 4 of the connecting member 2 could incorporate flexible arms (not shown) for correct positioning, or could have an open profile in the form of a split tube having a degree of resilience, thus forming resilient arms to provide clamping around the pins 5.

FIG. 18 shows a second step of assembly. The spiral support 17 fitted with the spiral spring 1 is connected to the balance bridge 9 by the angular positioning member 6, by means of two screws 13 which pass through openings 6*d* in the member 6 and are screwed into the tapped holes 17*a* of the support 17. The whole assembly is correctly positioned by means of the extended length of the pins 5 which are housed in adjusted openings 6*e* in the member 6.

FIG. 19 shows the complete assembly. In this case it can be seen that the angular positioning member 6 is provided with a ring 6*b* having a slit 6*c* for the angular positioning of the regulating member by friction around the bearing 11 of the balance wheel shaft, which is fixed to the balance bridge 9, thus permitting simple setting of the reference position.

The manufacturing tolerances of the spiral support 17 are greater than those of the spiral spring 1, and consequently the clearance at each fixing 17*c* can be adjusted to provide the most precise retention possible without overloading the system and making it statically indeterminate. A possible way of ensuring correct assembly is to leave a greater clearance at the intermediate fixing point 17*c*', which then has a greater diameter than the others, in order to absorb the various errors due to the manufacturing tolerances on the other components. An alternative method is to specify the clearances of all the attachment points as a function of the tolerances of the rigid part.

The lower face of the spiral support 17 has a cut-out 17*e* to avoid friction with the spiral spring. The arms 17*d* of the support 17 act as a stop to prevent deformations of the spiral 1 under the effect of an impact.

A second embodiment is shown in FIGS. 20 to 22. This solution uses the spiral spring of FIG. 8, but can also be used with any other spiral spring having a similar connecting member 2. In this solution, the more rigid annular connecting member 2 is clamped axially between an intermediate fixing part 7, having a positioning recess 7*a* (FIG. 22) to receive the annular connecting member 2, and the balance bridge or an angular positioning member. This positioning recess 7*a* allows the reference position of the spiral-spring and balance wheel regulating member to be set when the inner end of the spiral is assembled onto the balance wheel shaft. Two fixing screws 13 are used to clamp the annular connecting member 2 between the balance bridge 9 and the intermediate fixing part 7, the depth of the recess 7*a* formed in the intermediate fixing part 7 being a few hundredths of a millimeter smaller than the thickness of the annular connecting member 2 (FIG. 22).

In this case there are not at least two separate fixing or stud points, but a fixing on a bearing surface extending over an arc of a circle of at least 60°. This solution provides simple reference position setting and facilitates the inspection and assembly operations. This is because there is no element covering the spiral spring, and all the turns of the spring remain visible.

Figure 23:
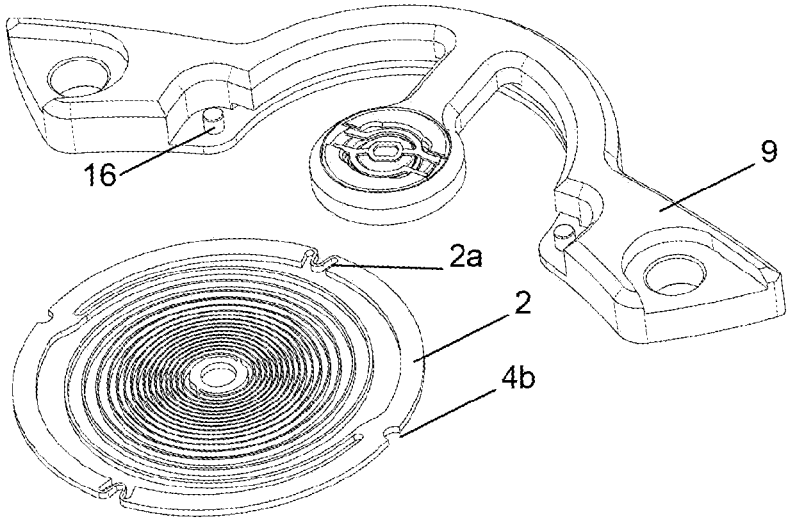
FIG. 23 is a perspective view of a first variant of a third embodiment.
Figure 24:
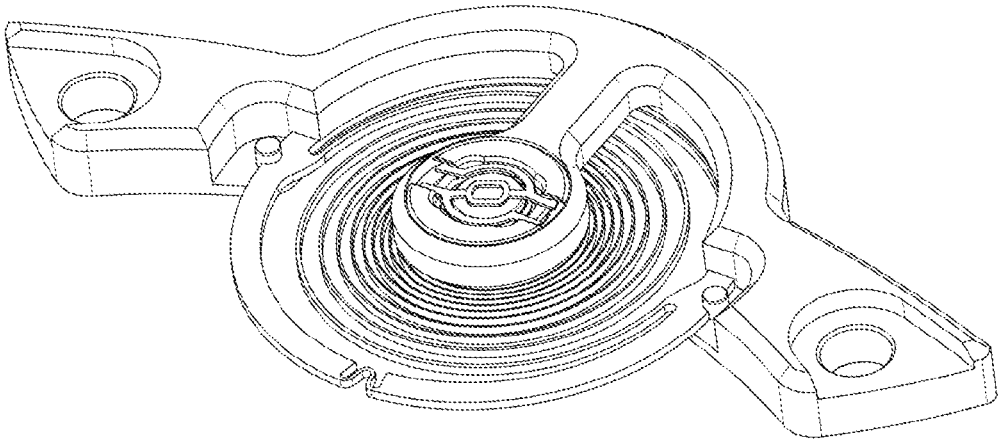
FIG. 24 is a perspective view of FIG. 23 with the spiral spring fastened to the bridge.

In a third embodiment, resilient arms 2*a* separate two parts of the annular connecting member 2, thus enabling the annular connecting member 2 to be clipped, in the variant shown in FIGS. 23 and 24, around pins 16 pressed into the balance bridge 9, centering being provided by two positioning elements 4*b* (centering cut-outs) formed in the connecting member 2. The bearing surface extends over an arc of a circle of at least 60°.

Figure 25:
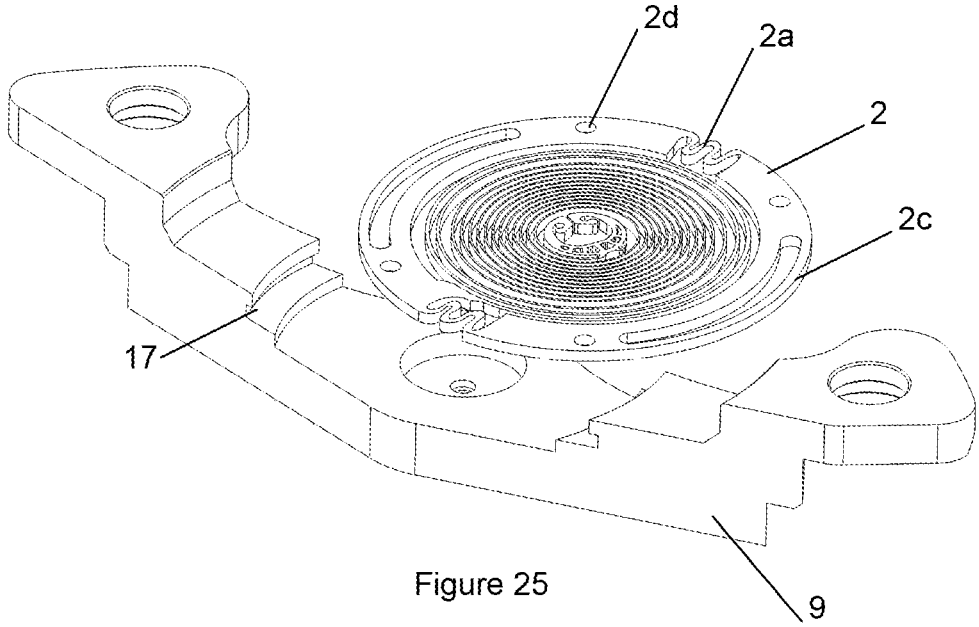
FIG. 25 is a perspective view of a fourth embodiment.
Figure 26:
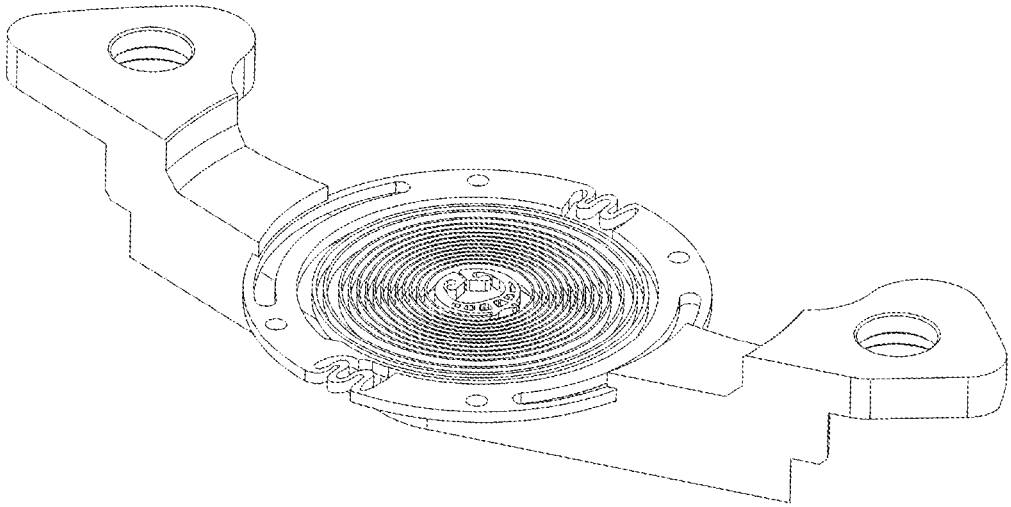
FIG. 26 is a perspective view of FIG. 25 with the spiral spring fastened to the bridge.

In a fourth embodiment, similar to the preceding one, resilient arms 2*c* are formed, in addition to or in place of the resilient arms 2*e*, in the edge of the annular connecting member 2 (FIGS. 25 and 26) to enable the ring to be clipped into housings 17 formed for this purpose in the balance bridge 9. The reference position can be set by modifying the angular position of the spiral, for example by means of tools which are inserted into passages 2*d* formed in the connecting member 2.

These different features, notably the different features of the different embodiments, and/or these different embodiments can be combined with each other provided that they are not incompatible.

The invention claimed is:

1. A spiral-spring and balance regulating member (10) assembly comprising:

a frame (9) designed to be mounted in a timepiece, and a regulating member (10), wherein the regulating member (10) comprises a pivot shaft mounted pivotably on the frame (9), a spiral spring (1) including at least one blade located in a plane, a connecting member (2) for connection to the frame (9) or to a an angular positioning member (6) for the angular positioning of the regulating member (10) on the frame (9), a rigidity of the connecting member (2) being substantially greater than a rigidity of the spiral spring (1), wherein an inner end of the spiral spring (1) is fixed to the pivot shaft and an outer end of the spiral spring (1) is integral with the connecting member (2), wherein both (i) the connecting member (2) and (ii) the frame (9) or the member (6) for the angular positioning of the regulating member (10) on the frame (9) have respective bearing surfaces which are at least partially complementary to each other and substantially parallel to the plane of the spiral spring, the complementary bearing surfaces being joined fixedly to each other, wherein the connecting member (2) includes at least two positioning elements (4) distributed angularly about the pivot shaft.

2. The regulating member as claimed in claim 1, wherein the bearing surfaces extend over an angular portion of more than 60°.

3. The regulating member as claimed in claim 1, wherein the bearing surfaces are continuous.

4. The regulating member as claimed in claim 1, wherein at least one of the bearing surfaces is a single surface that extends for more than 60° about the pivot axis of the pivot shaft.

5. The regulating member as claimed in claim 1, wherein at least one of the bearing surfaces is discontinuous.

6. The regulating member as claimed in claim 5, wherein two elements of the at least one discontinuous bearing surface are positioned at more than 60° to each other about the pivot axis of the pivot shaft.

7. The regulating member as claimed in claim 5, wherein two elements of the at least one discontinuous bearing surface are positioned at more than 120° to each other about the pivot axis of the pivot shaft.

8. The regulating member as claimed in claim 7, wherein each of the two elements extends over more than 10° about the pivot axis of the pivot shaft.

9. The regulating member as claimed in claim 7, wherein each of the two elements extends over more than 20° about the pivot axis of the pivot shaft.

10. The regulating member as claimed in claim 5, wherein two elements of the at least one discontinuous bearing surface are positioned at more than 120° to each other about the pivot axis of the pivot shaft.

11. The regulating member as claimed in claim 5, wherein two elements of the at least one discontinuous bearing surface are positioned at 180° to each other about the pivot axis of the pivot shaft.

12. The regulating member as claimed in claim 1, wherein a profile and angular extension of the at least partially complementary respective bearing surfaces have shapes and sizes with respect to a pivot axis of the pivot shaft such that a three-dimensional integrity of an initial shape of the spiral spring (1) is preserved in a resting state after the complementary bearing surfaces have been fixed to each other.

13. The regulating member as claimed in claim 1, wherein an angular interval between the positioning elements is in the range from 60° to 180°.

14. The regulating member as claimed in claim 1, comprising an angular positioning member (6), wherein the angular positioning member (6) is mounted pivotably about a bearing (11) for pivoting of the pivot shaft on a balance bridge of the frame (9).

15. The regulating member as claimed in claim 1, wherein the connecting member (2) is an annular member.

16. The regulating member as claimed in the claim 15, wherein the annular connecting member (2) is positioned between an intermediate fixing part (7), which has a positioning recess (7*a*) for receiving the annular connecting member (2), and a lower face of a balance bridge of the frame (9), the annular connecting member (2) being clamped between the intermediate fixing part (7) and the balance bridge of the frame (9).

17. The regulating member as claimed in claim 1, comprising an angular positioning member (6), wherein the angular positioning member (6) has a shouldered pin (14) to engage with a bayonet fixing opening (9*a*) in a balance bridge of the frame (9), a foil (15) being positioned between a plate of the balance bridge of the frame (9) and, on the one hand, a shoulder of the pin (14), and on the other hand a shouldered screw (16) screwed so as to bear against the connecting member (2), the foil creating a frictional torque to retain the connecting member (2) while allowing a reference position of the regulating member to be set.

18. The regulating member as claimed in claim 1, comprising an angular positioning member (6), wherein the spiral spring (1) includes two blades, wherein respective outer ends of the blades are fastened to the connecting member (2), the spiral spring being fixed to the angular positioning member (6) by a more rigid spiral support element (17), said spiral support element being fixed to the connecting member with the aid of screws (18).

19. The regulating member as claimed in claim 1, comprising an angular positioning member (6), wherein the angular positioning member (6) includes a split ring (6*b*) for frictional connection around a bearing (11) of the pivot shaft, fastened to a balance bridge of the frame (9).

20. The regulating member as claimed in claim 1, wherein the annular connecting member (2) includes resilient parts (2*a*, 2*c*) shaped so as to interact with clipping means (17) of the frame (9).

21. The regulating member as claimed in claim 20, including positioning elements (4*b*) complementary to positioning means (16) of the frame (9), wherein the clipping means keep the positioning elements and means engaged with each other.

22. A timepiece movement comprising a regulating member as claimed in claim 1.

23. A timepiece comprising a regulating member as claimed in claim 1.

24. The regulating member as claimed in claim 1, wherein at least one of the bearing surfaces is a single surface that extends for more than 120° about the pivot axis of the pivot shaft.

25. The regulating member as claimed in claim 1, wherein at least one of the bearing surfaces is a single surface that extends for 180° or more about the pivot axis of the pivot shaft.

26. A spiral-spring and balance regulating member (10) comprising:

a pivot shaft designed to be mounted pivotably on a frame (9) of a timepiece, a spiral spring (1) including at least one blade located in a plane, a connecting member (2) for connection to the frame (9) or to an angular positioning member (6) for the angular positioning of the regulating member (10) on the frame (9), a rigidity of the connecting member (2) being substantially greater than a rigidity of the spiral spring, wherein an inner end of the spiral spring is fixed to the pivot shaft and an outer end of the spiral spring is integral with the connecting member (2), wherein the connecting member (2) has a bearing surface substantially parallel to a plane of the spiral spring, wherein the bearing surface extends at least one of (i) over an angular portion of more than 60° and less than 360° about a pivot axis of the pivot shaft, (ii) excentrically with respect to the pivot axis of the pivot shaft to form a bearing surface of an excentric protrusion member, or (iii) over 360° about the pivot axis of the pivot shaft, and has no holes therein.

27. A spiral-spring and balance regulating member assembly comprising the regulating member (10) of claim 20 and a frame (9) designed to be mounted in a timepiece, wherein the frame (9) or a positioning member (6) for the angular positioning of the regulating member (10) on the frame (9) has a bearing surface which is at least partially complementary to the bearing surface of the regulating member (10), wherein the bearing surface of the frame (9) or positioning member (6) is substantially parallel to the plane of the spiral spring, wherein the bearing surface of the frame (9) or positioning member (6) extends at least one of (i) over an angular portion of more than 60° and less than 360° about the pivot axis of the pivot shaft, (ii) excentrically with respect to the pivot axis of the pivot shaft to form a bearing surface of an excentric protrusion member, or (iii) over 360° about the pivot axis of the pivot shaft, and has no holes therein, wherein the complementary bearing surfaces are joined fixedly to each other.

* * * * *